United States Patent [19]

Scammacca

[11] Patent Number: 4,502,306

[45] Date of Patent: Mar. 5, 1985

[54] LOCKING DEVICE FOR THE OUTBOARD STERN DRIVE OF A BOAT

[76] Inventor: Paul Scammacca, 7202 Ft. Hamilton Pkwy., Brooklyn, N.Y. 11228

[21] Appl. No.: 398,752

[22] Filed: Jul. 15, 1982

[51] Int. Cl.[3] ..... B65D 55/14; E05C 17/54; F16B 41/00

[52] U.S. Cl. ..... 70/159; 70/163; 70/232; 70/DIG. 49; 70/DIG. 57; 292/339; 440/900

[58] Field of Search ..... 114/172; 440/49, 113, 440/900; 292/338, 339; 70/57, 158, 159, 162, 163, 164, 166, 170, 232, DIG. 30, DIG. 49, DIG. 57

[56] References Cited

U.S. PATENT DOCUMENTS

| | | | |
|---|---|---|---|
| 1,421,726 | 7/1922 | Saunders | 70/164 |
| 1,656,686 | 1/1928 | Tjepkes | 70/170 |
| 1,657,283 | 1/1928 | Schilling | 70/170 |
| 1,711,535 | 5/1929 | Leet | 70/158 |
| 1,899,043 | 2/1933 | Marden | 70/DIG. 57 |
| 1,902,456 | 3/1933 | Matthews | 70/159 |
| 1,938,886 | 12/1933 | York et al. | 70/170 |
| 2,613,258 | 10/1952 | Azano | 70/DIG. 30 |
| 2,615,322 | 10/1952 | Gazda | 70/159 |
| 2,996,731 | 8/1961 | Leptrone | 292/339 |
| 3,180,473 | 4/1965 | Garvey | 70/159 |
| 3,581,700 | 6/1971 | Storch | 440/900 X |
| 3,757,549 | 9/1973 | Mullis, Jr. | 70/232 |
| 3,941,344 | 3/1976 | Paterson | 440/900 X |
| 4,058,994 | 11/1977 | Coppola | 70/159 X |
| 4,228,983 | 10/1980 | Bowman, Jr. | 70/232 X |
| 4,313,321 | 2/1982 | Wasser | 70/159 |
| 4,325,701 | 4/1982 | Peters et al. | 70/163 X |
| 4,335,909 | 6/1982 | Schmitz, Jr. | 70/159 X |
| 4,418,553 | 12/1983 | Applegate | 70/164 |

FOREIGN PATENT DOCUMENTS

| | | | |
|---|---|---|---|
| 168967 | 7/1934 | Switzerland | 292/338 |
| 2054227 | 2/1981 | United Kingdom | 70/DIG. 49 |

*Primary Examiner*—Robert L. Wolfe
*Assistant Examiner*—Lloyd A. Gall
*Attorney, Agent, or Firm*—Goodman & Teitelbaum

[57] ABSTRACT

A locking device for locking an outboard stern drive mechanism against removal from the stern of a boat, the locking device including a U-shaped cover member adapted to cover the stern drive mechanism. Support brackets are secured outboard of the stern and flanking the stern drive mechanism. The U-shaped cover member is pivotally connected to the brackets so that the cover member can be moved between a raised position providing access to the stern drive mechanism and a lowered position for covering the stern drive mechanism to prevent theft thereof. A locking member securely locks the cover member in its lowered position. The locking member includes a locking bar having a finger for extending into an opening in the stern drive mechanism so as to prevent the steering of the boat and operation of the stern drive mechanism.

9 Claims, 4 Drawing Figures

LOCKING DEVICE FOR THE OUTBOARD STERN DRIVE OF A BOAT

BACKGROUND OF THE INVENTION

This invention relates to locking devices for an outboard OMC stern drive, or similar out drives, and more particularly, a locking device for preventing unauthorized removal or unauthorized utilization of an outboard stern drive mechanism connected to the intermediate housing.

The stern drive is usually connected by means of screws or bolts to the intermediate housing. These drive mechanisms are easy targets for thefts when the boat is docked.

Some of these outboard drive mechanisms are coupled to the boat by means of pivot caps and bolts, connected to the intermediate housing.

However, many stern drive mechanisms are coupled to the intermediate housing, being located at the center of the lower part of the transom, so that they partially extend beneath the surface of the water level. Such mechanisms typically include the drive mechanism which is used to steer the boat. By way of example, one such stern drive mechanism includes upper and lower gear case sections which are bolted together. A lever extends from the upper gear case through the transom to the interior of the boat. The drive mechanism is connected by a cable to the steering wheel.

With this latter type of drive mechanism, there is a need for a suitable locking device to avoid unauthorized tampering and removal of the stern drive mechanism. In the prior art, there is provided an accessory in the form of a protective bumper which can be pivotally lowered to guard the motor against damage during use. Such device is described in U.S. Pat. No. 3,581,700. However, such device does not provide for any locking mechanism to prevent theft of the stern drive mechanism, nor does it provide for any way of preventing unauthorized use of such drive mechanism. In fact, this bumper protective device does not even enclose the motor or cover it, but only protects the front thereof.

Accordingly, there is a need for a locking device for use with such outboard stern drive mechanisms which are coupled to the exterior of the stern of the boat.

SUMMARY OF THE INVENTION

It is accordingly an object of the present invention to provide a locking device for locking an outboard stern drive mechanism against removal from the stern of the boat.

A further object of the present invention is to provide a locking device which can be selectively placed into a locking position to prevent unauthorized removal of the stern drive mechanism, and when in its non-locking position, gives complete access to the drive mechanism.

Yet a further object of the present invention is to provide a locking device which can be utilized to prevent unauthorized use of an outboard stern drive mechanism of a boat.

Another object of the present invention is to provide a locking device which can lock onto the outboard stern drive of a boat so as to prevent unauthorized steering of the boat.

A further object of the present invention is to provide a locking device for an outboard stern drive mechanism of a boat which simultaneously serves to lock the stern drive mechanism against unauthorized removal and also to prevent unauthorized use of the drive mechanism.

Briefly, in accordance with the present invention, there is provided a locking device for locking an outboard stern drive mechanism against removal from a boat. The locking device includes a U-shaped cover member which can cover the stern drive mechanism. Support brackets are secured to the intermediate housing, being located at the lower center part of the transom, thus flanking the drive mechanism. Suitable pivots connect the cover member to the support brackets whereby the cover member can be pivotally displaced between a raised position which provides access to the stern drive mechanism and a lowered position for covering the stern drive mechanism. A suitable locking apparatus is provided for securely locking the cover member in its lowered position.

When the stern drive mechanism is secured to the boat, it is usually done so by means of a number of fastening members such as cap screws. Also, the stern drive mechanism is typically formed of upper and lower gear case sections, which are secured together by suitable bolts. When the cover member of the locking device is in its lowered position, it simultaneously covers the fastening members holding the upper and lower gear case sections, and also covers the securing bolts to thereby prevent any unauthorized access to or removal of the stern drive mechanism.

The locking apparatus comprises a U-shaped cover member which covers the stern drive mechanism. The upper end of the cover can be locked in place by means of a locking bar.

The invention further contemplates a locking device which prevents unauthorized steering of the boat. Normally such steering is achieved by means of rotating at least a portion of an outboard stern drive mechanism through the use of a cable connected to the steering wheel. The locking device includes a U-shaped cover member which is pivotally coupled to the exterior of the stern drive mechanism, and movable between a raised position permitting operation of the stern drive mechanism and a lowered position covering the stern drive mechanism. A locking member is provided which has one portion that locks the cover into its lower position, and another portion which extends into an opening of the drive mechanism to thereby prevent rotation of the drive mechanism. Typically, the opening can be the exhaust opening which is already provided in the stern drive mechanism.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DESCRIPTION OF THE PREFERRED EMBODIMENTS

Figure 3:
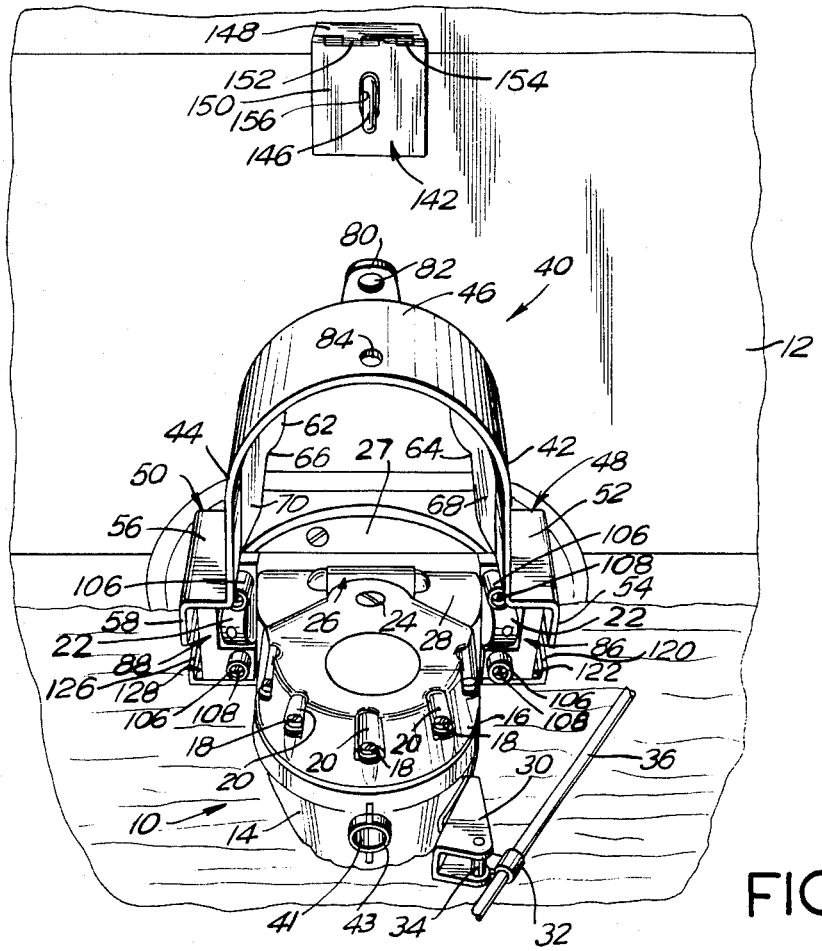
FIG. 3 is a fragmented rear perspective view of the stern of a boat, showing the locking device of the present invention in its raised position for permitting operational use of the stern drive mechanism.

Referring now to the drawings, the present invention is directed to a locking device which is used to prevent the theft of a stern drive mechanism connected to the boat. As shown in FIG. 3, the conventional stern drive mechanism 10 is coupled outboard through the transom 12. The stern drive mechanism 10 is shown to include an exhaust housing 14. Exhaust housing cover 16 is attached to the exhaust housing 14 by means of the bolts 18 received within the sockets 20 in the exhaust housing cover 16, with the bolts 18 extending into the exhaust housing 14. The exhaust housing cover 16 includes an upper gear casing oil fill 24. A rubber bumper 26 is connected to the exhaust housing cover 16 at the upper gear case 28. The upper gear case 28 is connected to an intermediate housing 27 by means of pivot caps 22 and bolts 108. The lower gear case is not shown, such lower gear case being conventional.

Connected to the exhaust housing 14 is a bracket 30 pivotally supporting a sleeve 32 by means of the pivot arrangement 34. A steering lever 36 passes through the sleeve 32. The steering lever 36 is connected to the steering cable (not shown), being coupled through a ball joint 38. The lever 36 has two sections interconnected by a telescopic operation at 39. The exhaust housing 14 includes an exhaust port 41 and a peripheral sleeve 43 formed about the exhaust port 41.

Thus, the stern drive mechanism 10 is coupled by means of the conventional pivot caps 22 and bolts 108 to the intermediate housing 27 which goes through the transom 12, the intermediate housing 27 being located on the lower center part of the transom. Details of the stern drive mechanism are well known and do not form a part of the present invention. Accordingly, alternate styles and types of stern drive mechanisms which are used in motor driven boats could be substituted for the particular stern drive mechanism generally shown and described herein.

Although use of the outboard stern drive mechanism is well-known, when the boat is docked, this type of stern drive mechanism is an easy target for unauthorized individuals to remove part of or the entire stern drive mechanism. Accordingly, it is important to prevent such unauthorized individuals from both gaining access to the stern drive mechanism as well as to prevent unauthorized operational use of the stern drive mechanism.

In order to prevent the unauthorized removal of the drive mechanism, it is necessary to protect the pivot caps 22 and bolts 108 which hold the drive mechanism to the intermediate housing 27 located on the transom 12. It is also necessary to protect the bolts 18 which interconnect the exhaust housing cover 16 to the exhaust housing 14. In order to prevent unauthorized use of the drive mechanism, it is further necessary to restrain the drive mechanism so as to prevent anyone from turning it by means of the lever 36.

Figure 1:
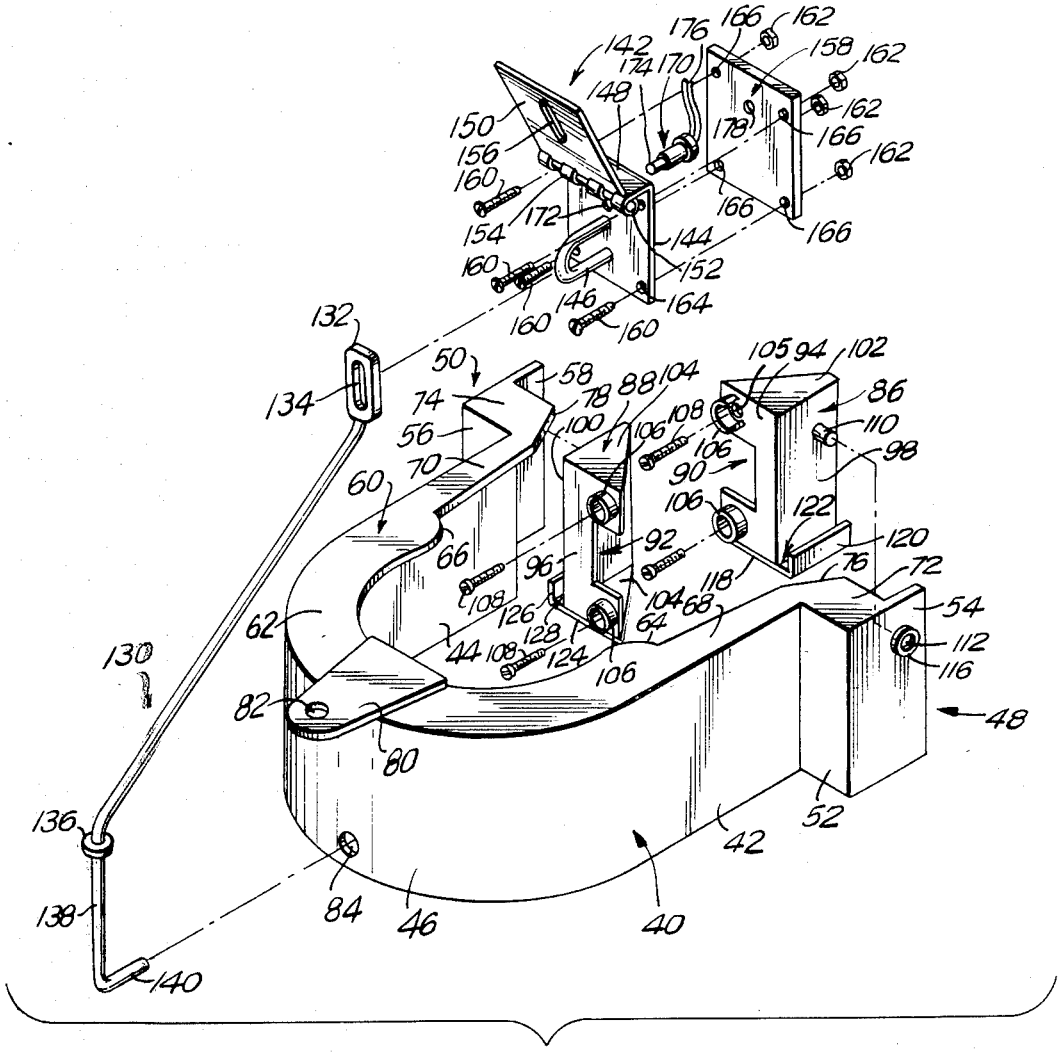
FIG. 1 is an exploded perspective view of the various parts of the locking device in accordance with the present invention.

The locking mechanism of the present invention serves to both protect the stern drive mechanism so as to prevent its unauthorized removal, and at the same time prevent unauthorized use of the drive mechanism to steer the boat. The locking mechanism as can best be seen in FIG. 1, includes a U-shaped cover member, shown generally at 40 having a peripheral wall forming side walls 42, 44 interconnected by the bight wall 46. At the distal ends of each of the side walls 42, 44, there are included offset foot portions generally indicated at 48, 50. The offset foot portion 48 includes a laterally extending flanged wall section 52 coupled to a forwardly extending wall section 54. Similarly, the offset foot portion 50 includes the laterally extending flanged wall section 56 terminating in a forwardly extending wall section 58.

At the upper edge of the U-shaped member 40, there is provided an inwardly directed flange 60. The flange 60 only extends partially across the top of the cover member 40 so as to form a partial top wall. The shape of the flange 60 is shown to include a substantially semicircular arcuate section 62 terminating in shoulders 64, 66, and continuing in the tapered sections 68, 70. The offset foot portions 48, 50 have their upper flanted sections 72, 74 which are L-shaped and are interconnected to the sections 68, 70 by means of the angled edges 76, 78 respectively. It should be noted, however, that the particular unique shape shown for the top wall is arbitrary and alternative shapes could be utilized. The main object is to provide a top portion which can fit over the upper surface of the stern drive mechanism 10.

Overlying the semicircular top flanged section 62 and extending forward therefrom is an arcuately shaped tab 80 which overlies the top wall 60 and is cantilevered outwardly therefrom. An aperture 82 is formed at the distal end of the tab 80. Adjacent the lower portion of the bight wall 46, there is provided a transverse aperture 84 extending through the wall. The aperture 84 is so positioned as to be vertically aligned with the above aperture 82, and also aligned horizontally with the exhaust port 41 in the stern drive mechanism when the U-shaped cover member 40 is positioned over the stern drive mechanism 10.

Two support brackets 86, 88 are provided. The support brackets are shown as hollow elongated blocks having a triangular cross-section with U-shaped cut-outs 90, 92 respectively, formed therein along the elongated dimension. The cut-outs define a C-shaped front wall 94, 96 respectively, on each support bracket. The support brackets also include side walls 98, 100 interconnected respectively to the angled top and bottom walls 102, 104. Apertures 105 are formed through the C-shaped walls 94,96, adjacent the opposing distal ends of the C-shaped walls 94, 96. These apertures 105 are concentrically surrounded by raised sleeves 106 which are spaced from the apertures 105 as shown by the broken-away upper sleeve 106 of wall 94 in FIG. 1.

The support brackets 86, 88 are mounted to the pivot caps 22 with the pivot cap bolts 108 extending to the intermediate housing 27. Furthermore, they are positioned so that the threaded shanks of the cap bolts 108, which serve to hold the stern drive mechanism to the intermediate housing 27, pass through the apertures 105. The enlarged heads of the cap bolts 108 engage the walls 94, 96 around the apertures 105 and are contained within the sleeves 106. In this way, the sleeves 106 provide an enclosure for the cap bolt heads so as to prevent unauthorized access to the cap bolts when the locking mechanism is in its locked position, as will hereinafter be described.

The U-shaped cover member 40 is pivotally connected to the support brackets 86, 88 by means of suitable pivot pin 110 passing through the aperture 112 formed in the wall 54 of foot portion 48. The pin 110 is secured to the wall 98 of the bracket 86. On the opposing side, a similar aperture is provided in the foot portion 50 to receive a pin secured to the wall 58 of the bracket 50. The specific type of pivoting pin used can be a rivet. The pins 110 are retained in place by means of bushings 116 secured to the walls 54, 58 around the apertures 112 to prevent the pins 110 from being sheared off by an unauthorized person. It should be understood that any other type of pivoting arrangement could be utilized.

At the lower end of the bracket 86, there is secured a bottom plate 118 which extends laterally beyond the side wall 98 and terminated in an upturned flange or lip 120 so as to define a channel 122 between the outer flange 120 and the adjacent wall 98. This channel 122 receives the lower edge of the side wall 54 when the cover member 40 is in its lowered position. A similar plate 124 is likewise secured to the bracket 88 and terminates in an upwardly turned flange or lip 126 to define a channel 128 for receiving the lower edge of the side wall 58 in the lowered position of the cover member 40.

A locking bar 130 is provided including an angularly oriented connecting rod terminating at its upper end in an upwardly directed flattened tab section 132 having an elongated slot 134 formed therein. At its lower end, the locking bar 130 includes a stop washer 136 secured at the junction with a downwardly directed rod section 138 extending from the angularly oriented connecting rod. The section 138 terminates in an inwardly directed finger or prong 140.

The locking mechanism of the present invention also includes a hasp 142 which includes a rear fixed hinge plate 144 securely supporting a U-bolt 146 which is receivable in the slot 134 of the tab section 132 of the rod 130. The upper end of the hinge plate 144 terminates in a forward directed flange 148. A movable hinge plate 150 is connected to the forwardly directed flange 148 by means of the hinge pin 152. A suitable hinge arrangement is provided so that alternate sections formed between the plate 150 and the flange 148 define sleeve portions 154 for accommodating therethrough the hinge pin 152. A movable hinge plate 150 includes an elongated slot 156 which can receive the U-bolt 146 therethrough when the movable hinge plate 150 is pivoted onto the tab section 132 of the rod 130 when positioned on the U-bolt 146.

A base plate 158 is provided which is securely fastened onto the outside wall of the transom of the stern 12. A series of bolts and nuts 160, 162 are provided, whereby the bolts 160 pass through suitably provided apertures 164 in the fixed hinge plate 144 through aligned apertures in the transom, and through correspondingly aligned apertures, 166 in the base plate 158 to secure the plate 144 to the base plate 158 by the nuts 162, so that the hasp 142 in turn is secured onto the transom with the fixed hinge plate 144 being secured onto the outside wall of the transom.

An alarm switch, shown generally at 170, is sandwichly positioned in a suitable hole in the transom so that only a forward end thereof can extend through the aperture 172 in the fixed hinge plate 144, and the base plate 158 is positioned securely against the back end of the alarm switch. The alarm switch 170 has a spring-biased push button forward end 174, of reduced diameter, which must remain in a retracted position to keep the alarm off. Suitable wires 176 extend from the switch 170 and pass through the aperture 178 in the base plate 158 to the alarm mechanism itself, the aperture 178 being smaller than the back end of the alarm switch. When the movable hinge plate 150 is closed onto the fixed hinge plate 144, the tab section 143 of the rod 130 pushes the end 174 in so that the alarm switch 170 is off. When the hinge plate 150 is displaced from the fixed hinge plate 144, and the tab section 132 is removed, the forward end 174 of the switch 170 is spring-biased forward to trigger the alarm mechanism.

Figure 4:
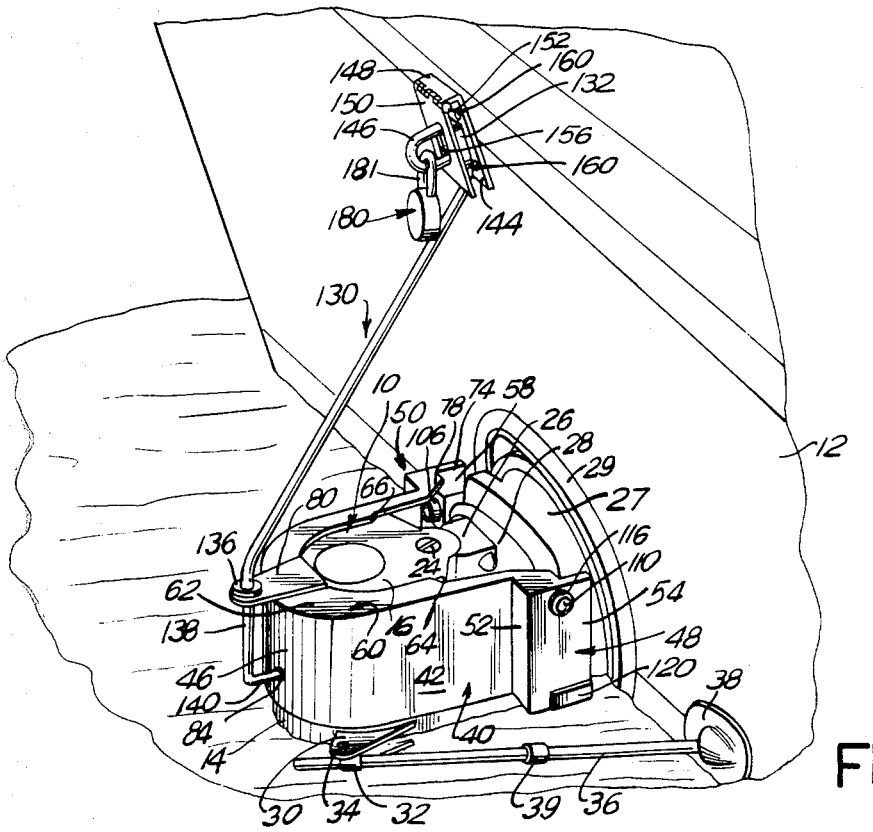
FIG. 4 is a fragmented side perspective view similar to FIG. 3, showing the locking device in its lowered position where it simultaneously prevents unauthorized access to the stern drive mechanism as well as preventing unauthorized steering of the boat.

The operation and use of the locking mechanism of the present invention can best be described with regard to FIGS. 3 and 4. In FIG. 3, it will be noted, that the support brackets 86, 88 are connected to the intermediate housing 27 flanking the stern drive mechanism 10, with the cap bolts 108 being inserted through the sleeves 106 of the brackets and also through the pivot caps 22 to the intermediate housing 27. In this way, the cap screws 108 hold the stern drive mechanism, with the heads of the cap bolts being secured against the brackets, thereby the cap bolt heads are protected by the sleeves 106 as well as by the brackets 86, 88. The U-shaped cover member 40 is pivoted on the brackets with the offset feed 48, 50 positioned outwardly of the brackets 86, 88.

In its upper, raised position, as shown in FIG. 3, the U-shaped cover member 40 is lifted so that it is adjacent to the transom 12 of the boat. In this position, there is complete access to the entire stern drive mechanism 10 without any impediment from the locking device. It also permits the lever 36 to suitably rotate the drive mechanism in order to properly steer the boat without interference from the locking device.

It is noted, that the hasp 142 is suitably connected to the transom spaced from the U-shaped cover member 40. With the U-shaped cover member in its raised position, the hasp is not utilized, so that the alarm mechanism is manually switched off by the operator of the boat in a conventional manner.

When it is desired to close the locking device, the U-shaped cover member 40 is lowered to the position shown in FIG. 4. In this position, the side walls 54, 58 of the offset feet 48, 50 are brought down so as to fit within the receiving channels 122, 128 laterally extending from the support brackets 86, 88. These channels form a bottom stop for the lowering limit of the U-shaped cover member 40.

When the U-shaped member 40 is lowered, it will be noted that it completely encloses the periphery of the stern drive mechanism. The walls 42, 44 and bight 46 extend downwardly so as to cover the bolts 18 which connect the exhaust housing cover 16 to the exhaust housing 14. Accordingly, with the U-shaped cover member 40 in its lowered position, it is impossible to have access to and remove the stern drive mechanism 10 from the boat.

In order to retain the cover member 40 in its lowered position, the locking bar 130 is connected in a wedge-like fashion between the cover member 40 and the transom 12. This is achieved by inserting the finger 140 and the vertical section 138 of the locking bar 130 into the aperture 82 of the tab 80 until the stop washer 136 abuts the upper surface of the tab 80. The finger 140 is then inserted into the aperture 84 so that it extends into the exhaust port 41 of the stern drive mechanism 10.

With the movable hinge plate 150 lifted off the fixed hinge plate 144, the flattened tab 132 of the locking bar 130 is placed over the fixed hinge plate 144 with the U-bolt 146 extending through the slot 134 in the flattened tab 132, whereby the tab 132 engages and pushes in the alarm push button 174, as set forth above. The movable hinge plate 150 is then lowered so that the hasp is closed with the U-bolt 146 passing through the slot 156. A conventional padlock 180 is then inserted through the U-bolt with the shackle portion 181 passing through the U-bolt 146 to lock the hasp 142 with the flattened tab 132 sandwiched therebetween. With the hasp locked, the locking bar 130 is secured in place and serves as a wedge to retain the cover member 40 in its lowered position.

The locking bar 130 simultaneously serves as a retaining member to prevent the stern drive mechanism 10 from being operated. Specifically, with the finger 140 inserted into the exhaust port 41, the drive mechanism is prevented from being turned by lever 36. Accordingly, even if one tries to steal the boat itself, the unauthorized individual would not be able to steer the boat as long as the locking device of the present invention is in its locked position.

Figure 2:
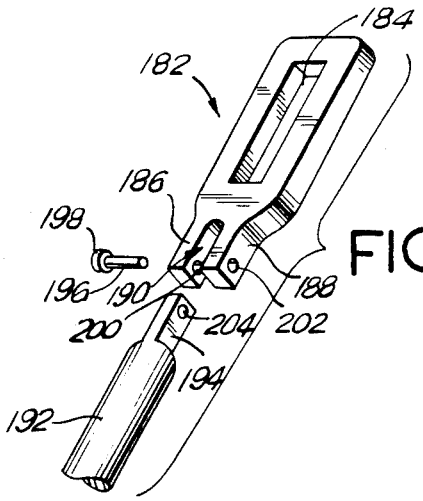
FIG. 2 is an exploded perspective view of the upper end of the locking bar in accordance with an alternate embodiment of the present invention.

Referring now to FIG. 2, it will be noted that an alternate embodiment of the upper end of the locking bar 130 is shown. Specifically, a flattened tab portion 182 is shown formed in a substantially rectangular configuration and having the elongated slot 184 formed therein. At the lower end, there are formed a pair of bifurcated feet 186, 188 separated by a channel 190.

The upper end 192 of the locking bar is longitudinally flattened to form a tang 194 so as to fit into the channel 190. A pivot pin or rivet 196 having a head portion 198 is inserted through aligned apertures 200, 202 in the feet 186, 188 as well as through a correspondingly aligned aperture 204 in the flattened tang 194. After being inserted, the end of the pin 196 is flattened or deformed to retain the pin 196 in the apertures 200, 202, 204.

With the embodiment of FIG. 2, the upper flattened tab 182 can pivot with respect to the upper end 192 of the locking bar so as to be suitably positioned in the hasp. This pivoting arrangement is especially of value when the transom of the boat is angled, which would prevent accurate positioning of a vertical tab 132 as was shown in the first embodiment. Also, by providing for the pivot arrangement, a universal locking mechanism is provided which can fit onto numerous boats regardless of the angular orientation of the transom 12.

There has been disclosed heretofore the best embodiments of the invention presently contemplated. However, it is to be understood that various changes and modifications may be made thereto without departing from the spirit of the invention.

What is claimed is:

1. A locking device for locking an outboard stern drive mechanism against removal from a stern of a boat and for preventing any steering of the boat by rotation of the stern drive mechanism through an operating lever, the stern drive mechanism being secured to an outside of the stern by a plurality of fastening members, the stern drive mechanism including an exhaust housing and an exhaust housing cover secured together by securing members, the exhaust housing having an exhaust opening therein, and the operating lever being connected to the exhaust housing, said locking device comprising:

(1) first means for locking the stern drive mechanism against removal from the stern, said first means including:

a cover member having a U-shaped peripheral wall and a flange inwardly directed from an upper edge of said peripheral wall for covering the stern drive mechanism;

support brackets secured outboard of the stern and flanking the stern drive mechanism;

pivot means for coupling said cover member to said brackets so that said cover member is pivotally displaceable between a raised position providing access to the stern drive mechanism, and a lowered position for covering the stern drive mechanism;

said inwardly directed flange providing partial top wall means for covering the securing members when said cover member is in said lowered position to prevent unauthorized access to the securing members;

said cover member including cover means for covering the fastening members when said cover member is in said lowered position to prevent unauthorized access to the fastening members;

locking means for securely locking said cover member in said lowered position, said locking means including a locking bar for wedging between said cover member and the stern, first securing means for securing said locking bar to said cover member and second securing means for securing said locking bar to the stern for retaining said locking bar in a wedged condition;

said first securing means including a receiving member extending outwardly from said cover member, said receiving member having an aperture to receive a lower end portion of said locking bar therethrough, and stop means positioned along said lower end portion and spaced from a lower end of said locking bar to maintain said lower end portion in said aperture to thus hold said cover member in said lowered position, said stop means being disposed against an upper surface of said receiving member; and (2) second means for preventing the steering of the boat, said second means including:

said cover member being provided with an aperture in said peripheral wall in alignment with the exhaust opening when said cover member is in said lowered position;

finger means extending through said peripheral wall aperture and into the exhaust opening for thereby preventing rotation of the stern drive mechanism when said cover member is in said lowered position;

said finger means including an inwardly directed finger extending from said lower end of said locking bar.

2. A locking device as in claim 1, wherein said locking bar has a slotted tab at its upper end, said second securing means including hasp means securely fastened to the stern of the boat and accomodating said slotted tab therein.

3. A locking device as in claim 2, wherein said slotted tab is pivotally coupled to said upper end of said locking bar.

4. A locking device as in claim 2, wherein said hasp means includes a fixed hinge plate securely fastened to the stern, a U-bolt extending from said fixed hinge plate, and a slotted swinging hinge plate pivotally coupled to said fixed hinge plate for closing onto said fixed hinge plate with said U-bolt extending through a slot of said swinging hinge plate.

5. A locking device as in claim 4, wherein said swinging hinge plate closes onto the fixed hinge plate in a spaced relation therefrom to sandwich said slotted tab therebetween with said U-bolt extending through a slot of said tab.

6. A locking device as in claim 4, and further comprising alarm switch means extending between said hinge plates and activated by removal of said tab from between said swinging hinge plate and said fixed hinge plate.

7. A locking device as in claim 1, wherein said cover member has opposing leg portions interconnected by a bight portion, and includes offset feet extending from said leg portions outwardly of said support brackets such that, in the lowered position of the cover member, said offset feet overlie said brackets to prevent tampering with said brackets.

8. A locking device as in claim 7, wherein said support brackets are provided with apertures for receiving said fastening members therethrough, and raised sleeves provided around said apertures for preventing unauthorized access to said fastening members when said cover member is in said lowered position.

9. A locking device as in claim 7, wherein said support brackets include laterally extending channel supports for supporting said cover member in said lowered position.

* * * * *